US005967374A

United States Patent [19]

Baker

[11] Patent Number: 5,967,374

[45] Date of Patent: Oct. 19, 1999

[54] DIAL WHEEL DISPENSER

[75] Inventor: Mark Phillip Baker, Fort Wayne, Ind.

[73] Assignee: Jefferson Smurfit Corporation (U.S.)

[21] Appl. No.: 09/090,343

[22] Filed: Jun. 4, 1998

[51] Int. Cl.[6] ..... B67D 5/60

[52] U.S. Cl. ..... 222/142.9; 222/142.6; 222/144.5; 222/486; 221/305

[58] Field of Search ..... 222/142.1, 142.6, 222/142.7, 142.9, 144.5, 486; 221/305, 306; 206/533

[56] References Cited

U.S. PATENT DOCUMENTS

| | | | |
|---|---|---|---|
| 2,258,866 | 10/1941 | Sanford | 206/42 |
| 2,335,016 | 11/1943 | Lorenzen et al. | 206/42 |
| 2,410,923 | 11/1946 | Beardsley | 206/42 |
| 2,774,466 | 12/1956 | Liska | 206/42 |
| 2,890,816 | 6/1959 | Horland | 222/142.9 |
| 2,948,389 | 8/1960 | Horland | 206/42 |
| 3,182,789 | 5/1965 | Sparks | 206/42 |
| 4,993,584 | 2/1991 | Macario | 222/142.1 |
| 5,322,166 | 6/1994 | Crowther | 206/538 |
| 5,370,220 | 12/1994 | Wang | 221/305 |
| 5,845,816 | 12/1998 | Krane | 222/142.9 |

*Primary Examiner*—Joseph A. Kaufman
*Attorney, Agent, or Firm*—Paul M. Denk

[57] ABSTRACT

A paperboard container for the containment and dispensing of small objects such as candies, including a back wall, a front wall, a pair of opposed side walls, a bottom wall and a top wall defining an inner chamber. In one preferred embodiment, the inner chamber is divided into three cells by a baffle. The front wall includes at least three openings, one each of the openings positioned to cooperate with one of each of the inner cells. A dial wheel is rotatably positioned between the inner cells and the front wall. The dial wheel includes a plurality of openings which are positioned in the dial wheel so that the dial wheel can be rotated to allow dispensing from any one of the cells or any combination of the cells, through aligned openings in the dial wheel and front wall. The dial wheel can be rotated to close the container.

11 Claims, 3 Drawing Sheets

DIAL WHEEL DISPENSER

REFERENCE TO RELATED APPLICATIONS

None

BACKGROUND OF THE INVENTION

This invention relates generally to containers and more specifically to a paperboard container having multiple individual compartments and a dial wheel type closure which allows dispensing from one or more of the individual compartments.

Containers or paperboard boxes are known to the art. Generally speaking, the uses for small paperboard containers or boxes are unlimited. These containers can hold any item from paperclips to pharmaceuticals. Commonly such containers are used to hold consumable items such as candy. Although the container of the present invention is intended have many uses, one preferred use is for the containment and dispensing of small individual candies. For simplicity, the preferred embodiment will be referred to in that environment, but such reference should not be construed to narrow the scope of the invention.

Paperboard containers used to contain small candies, for example, are generally comprised of four walls, a bottom wall and a top wall defining an inner chamber. The top wall can function as a lid, being movable about a fold line from an open position to a closed position or can have a small opening or even a spout-like structure formed therein. In most instances the container holds one homogeneous product in a single inner chamber. In exceptional circumstances the chamber can be divided by an internal wall or baffled to divide the inner chamber into discrete compartments.

It would be advantageous to have a paperboard container that could hold more than one type of candy, for example, in separate chambers or compartments from which one or more of the different types of candies could be dispensed. Dispensing containers are known to the art. Generally speaking, such containers are formed or molded from plastic, glass or the like and the designs do not lend themselves to construction from paperboard. Such dispensing containers are used to contain and dispense medicines, such as tablets, capsules or lead fishing weights. Examples of such dispensing containers are disclosed U.S. Pat. No. 2,258,866 to Sanford; U.S. Pat. No. 2,335,016 to Lorenzen et al; U.S. Pat. No. 2,410,923 to Beardsley; U.S. Pat. No. 2,774,466 to Liska; U.S. Pat. No. 2,948,389 to Horland; U.S. Pat. No. 3,182,789 to Sparks; and U.S. Pat. No. 5,322,166 to Crowther.

The known dispensers have limitations. For example, as stated above, they are designed to be manufactured from rigid materials such as plastic or glass and do not lend themselves to construction from paperboard. Further, some of the designs are limited in volume or capacity. For example, those container which are designed to dispense individual pills may only have the capacity to hold a 21 or 28 day supply. Often if the container can hold more than one type of product, for example, two different types of pills, the container is capable of dispensing only one type at a time. In other words, the container does not have the capacity to dispense a mix of different contents.

SUMMARY OF THE INVENTION

It is among the several objects of the present invention to provide a paperboard container for holding small discrete objects, such as candies, or other small dispensable items, that can separately contain more than one type or flavor of candy and dispense one candy or a combination of the different candies.

It is another object of the present invention to provide such a paperboard container that includes at least three internal storage compartments to hold at least three different objects, such as candies.

Another object of the invention is to provide such a paperboard container that includes a dispensing mechanism that allows the dispensing of objects from any one of the internal storage compartments or combination thereof.

Another object of the invention is to provide such a paperboard container that having a dispensing mechanism which includes a dial wheel that allows the dispensing of objects from any one of the internal storage compartments or combination thereof.

Yet another object of the invention is to provide such a paperboard container that can be erected from a paperboard blank.

Still another object of the invention is to provide such a paperboard container that is easy and fun for the consumer to use.

Another object of the present invention is to provide such a paperboard container that is economical to manufacture, easy to erect, convenient and fun to use and well suited for its intended purposes.

In accordance with the invention, generally stated, a paperboard container is provided for the containment and dispensing of small objects such as candies, the container including a back wall, a front wall, a pair of opposed side walls, a bottom wall and a top wall defining an inner chamber. In the preferred embodiment, the inner chamber is divided into three cells by a baffle. The front wall includes at least three openings, one of each openings positioned to cooperate with one of each of the inner cells. A dial wheel is rotatably positioned between the inner cells and the front wall. The dial wheel includes a plurality of openings which are positioned in the dial wheel so that the dial wheel can be rotated to allow dispensing from any one of the cells or any combination of the cells, through aligned openings in the dial wheel and front wall. The dial wheel can be rotated so that none of the dial wheel openings and front wall openings are in alignment, thereby closing the container.

BRIEF DESCRIPTION OF THE DRAWINGS

Corresponding reference numerals indicate corresponding structures throughout the various figures.

DESCRIPTION OF THE PREFERRED EMBODIMENT

Figure 4:
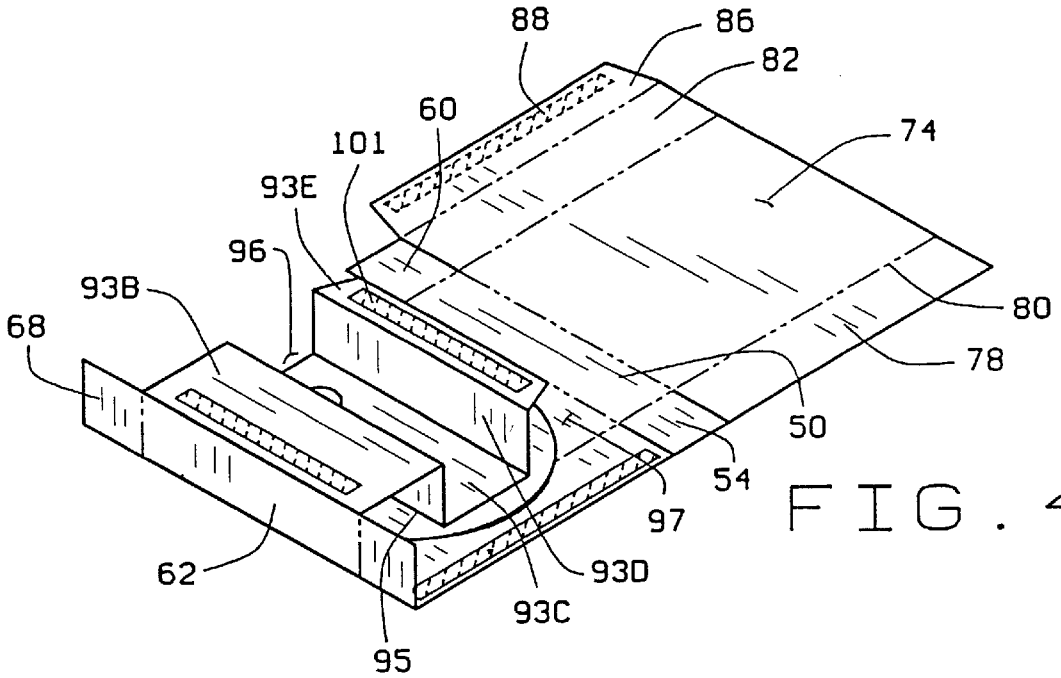
Figure 5:
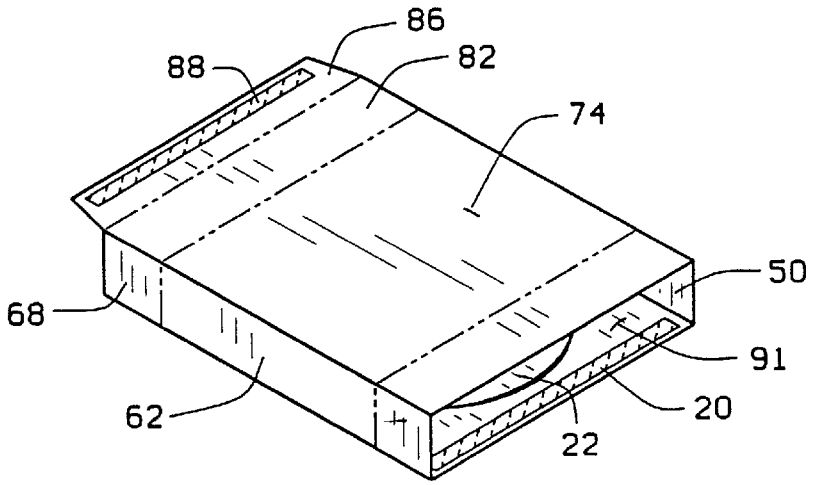
Figure 6:
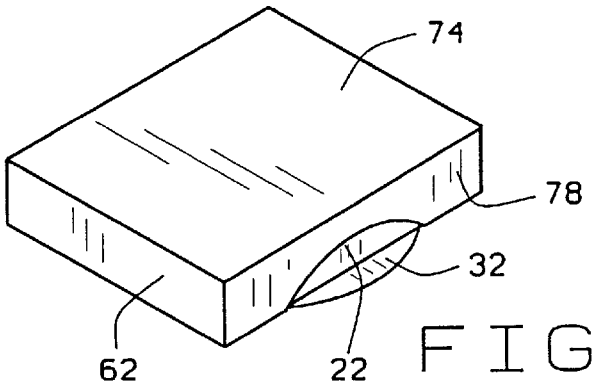
Figure 7A:
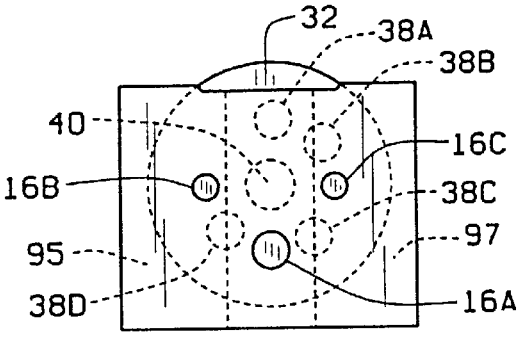
FIG. 7A–7H illustrate multiple alignments of the openings of dispensing dial with the openings of the front wall to allow dispensing from one or more cells within the container of the present invention.
Figure 7E:
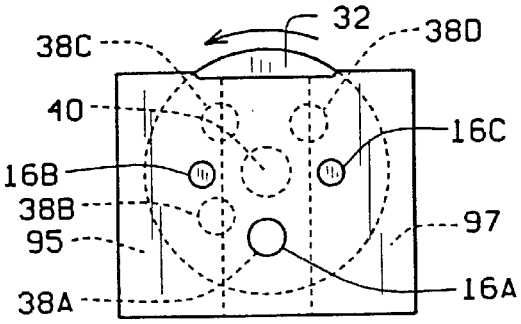
Figure 7B:
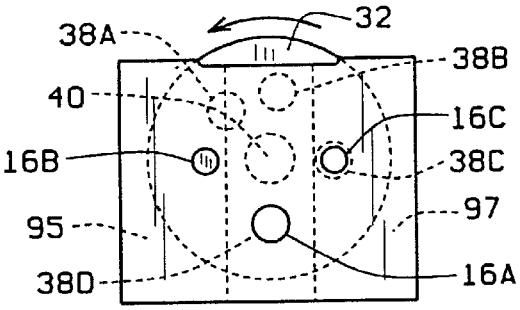
Figure 7F:
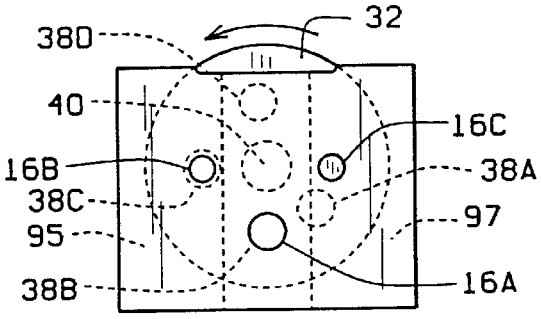
Figure 7C:
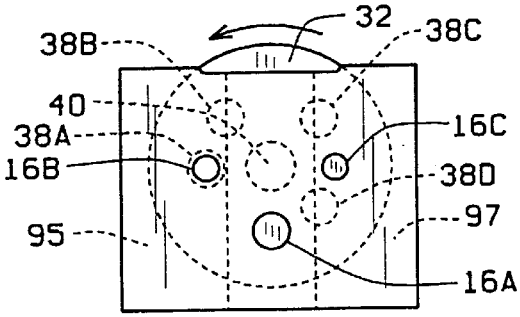
Figure 7G:
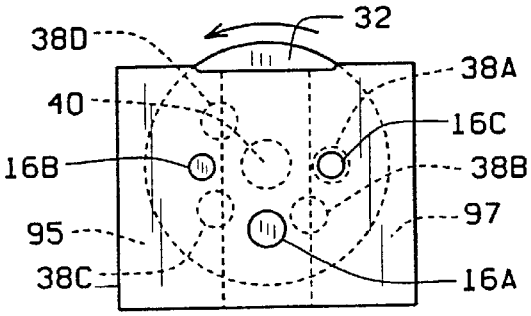
Figure 7D:
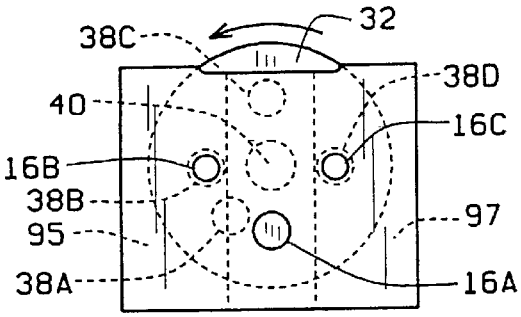
Figure 7H:
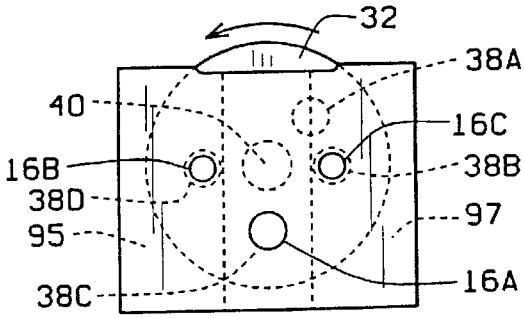

The novel paperboard dispensing container of the present invention is indicated generally by reference numeral 10 in the drawings. It will be appreciated by one skilled in the art that container 10 can be used to contain and dispense appropriately sized objects. While describing the use if container for the dispensing of such items as individual candies is done for the purpose of brevity and convenience, it should be understood that contents dispensed can be varied without departing from the scope of the invention. Container 10 is erected from a paperboard blank, indicated generally by reference numeral 12. FIGS. 4–6 illustrate how the various elements of blank 12 are folded or erected into container 10. The various elements of the dispensing container now will be described in greater detail.

As stated above, container 10 is erected from blank 12 and includes a front wall 14. Front wall 14 has a plurality of openings 16A, 16B and 16C formed therein. Although the illustrated embodiment includes three openings, 16A–16C, it will be appreciated that front wall 14 could include more or less openings. The number of openings included in front wall 14 is dependent upon the number of individual storage cells formed inside container 10, as will be described in greater detail below.

A top wall 18 is foldably joined to front wall 14 along fold line 20. Top wall 18 includes a slot 22 formed adjacent fold line 20. Top wall 18 also may include a line of suitable adhesive 24 for securing the top wall in its usable position when the container is fully erected.

A rotatable dispenser dial assembly 26 also is foldably attached to front wall 14 along fold line 28. Dial assembly 26 includes a base 30 and a dial 32. Dial 32 is partially severed from base 30 by cuts 34A and 34B but remains attached at nick 36 until rotated and broken free after erection. Dial 32 includes a number of openings, 38A, 38B, 38C and 38D. It will be appreciated that the openings 38A–38D are positioned in dial 32 so as to allow them to properly align with the openings 16A–16C in front wall 17 for dispensing purposes, as shown in FIGS. 7A–7H and as will be described in greater detail below.

Figure 2:
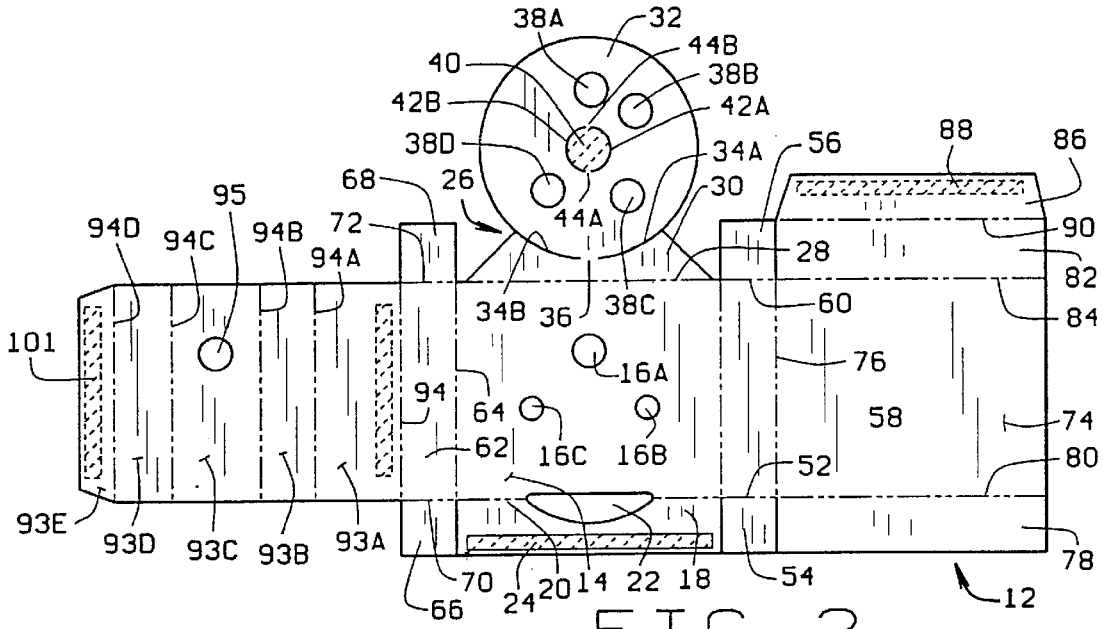
FIG. 2 is a top plan of the paperboard blank from which the dispensing container of FIG. is erected.
Figure 1:
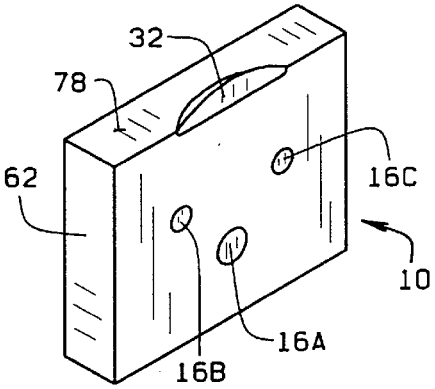
FIG. 1 is an isometric view of the paperboard dispensing container of the present invention.

Dial 32 also includes a hub 40. Dial 32 is partially severed from hub 40 by cuts 42A and 42B and remains attached by nicks 44A and 44B until broken free by rotation. Hub 40 also includes a suitable adhesive 46 (FIG. 3) on both sides to attach hub 40 either to the front wall 14 or to the baffle, which will be described, or both. When fully erected, as shown in FIGS. 1 and 6, dial 32 protrudes through slot 22 for rotatable access to dial 32 by the user, as will be explained below.

The container includes a first side wall 50 foldably connected to front wall 14 along fold line 52. Side wall 50 includes a top wall tab 54 and a bottom wall tab 56 both foldably attached to side wall 50 by fold lines 58 and 60 respectively. A second side wall 62 is foldably attached to front wall 14 along fold line 64. Side wall 62 includes a top wall tab 66 and a bottom wall tab 68 foldably connected thereto along fold lines 70 and 72 respectively.

A back wall 74 is foldably attached to first side wall 50 along fold line 76. A top wall 78 is foldably joined to the back wall along fold line 80 and a bottom wall 82 is foldably joined to back wall 74 along fold line 84. A locking tab 86 including appropriate adhesive 88 is foldably joined to the bottom wall 82 along fold line 90 so as to fold into place and secure the bottom wall. As can be seen in FIG. 5, the various walls cooperate to define an inner storage chamber 91.

Figure 3:
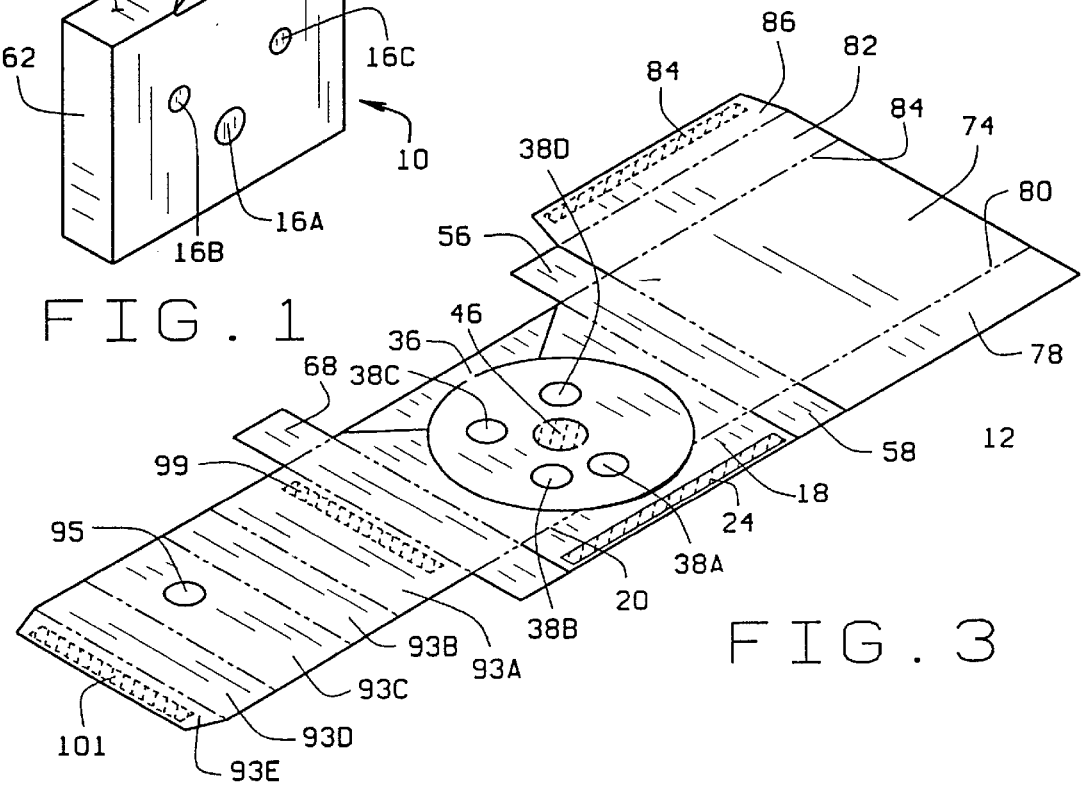
FIGS. 3–6 illustrate various steps of the paperboard blank of FIG. 2 being erected into the dispensing container of the present invention.

A baffle 92 is foldably attached to second side wall 62 along fold line 94. As can be seen in FIGS. 3 and 4, baffle 92 is comprised of five panels, 93A, 93B, 93C, 93D and 93E. The panels are foldably joined to each other by fold lines 94A, 94B, 94C and 94D. Panel 93C, the center panel, has an opening 95 therein. The construction of baffle 92 allows the baffle to be folded in an appropriate S-shaped configuration within storage chamber 91 so as to divide chamber 91 into three storage cells 95, 96 and 97. Panels 93A and 93E include adhesives 99 and 101 respectively, to secure the baffle in its useful position. It should be noted that when baffle 92 is erected so as to divide inner chamber 91 into three cells, each one of the cells cooperates with one of the openings 16A–16C in front wall 14 to provide a pathway for dispensing objects out of the cell through the front wall.

One skilled in the art will appreciate that, when erected, as shown in FIGS. 3–6, dial 32 is positioned between the center panel 93C and front wall 14. Adhesive 46 secures hub 40 either to the front wall or the middle panel. The three cells 95, 96 and 97 can be filled with discrete objects such as pieces of candy. Upon first use, dial 32 is rotated breaking it loose from hub nicks 44A and 44B as well as base nick 36 so that the dial is free to rotate about secured hub 40. As shown in FIGS. 7A–7H, the openings in dial 32 and the openings in front wall are positioned so that a user can align the holes and dispense from any one of the cells or any combination of the cells. Thus, if there are three different types or flavors of candies in the three cells, the user can dispense any one type of candy for consumption or any combination of candies, as desired, simply by rotating the dial. Of course, the dial can be rotated so that no openings cooperate, thereby effectively closing the container.

It will be appreciated by those skilled in the art that various changes and modifications may be made in invention without departing from the scope of the appended claims. Therefore, the foregoing description and accompanying drawings should be viewed as illustrative only and should not be construed in a limiting sense.

I claim:

1. A paperboard dispensing container comprising:

a back wall;

a pair of opposed side walls;

a bottom wall;

a front wall having a plurality of openings formed therein, said aforestated walls defining a storage chamber;

a baffle within said storage chamber, said baffle defining a plurality of cells within said chamber;

a rotatable dial wheel between said baffle and said front wall, said dial wheel having a plurality of openings formed therein.

2. The paperboard container of claim 1 wherein said container is erected from a paperboard blank.

3. The paperboard container of claim 1 wherein said openings in said dial wheel and said openings in said front wall are positioned so that said respective openings can be placed in alignment by rotation of said dial wheel.

4. The paperboard container of claim 1 wherein said top wall has a slot formed therein, the rotatable dial extending through the slot for rotatable access by a user.

5. The paperboard container of claim 1 wherein said dial wheel can be rotated to allow alignment of one or more of said openings in said dial wheel with said openings in said front wall, said openings, when in alignment, forming a continuous opening from at least one of said cells through said front wall for the dispensing of an object from said at least one cell.

6. The paperboard container of claim 1 wherein said baffled has at least one opening formed therein.

7. The paperboard container of claim 1 wherein said rotatable dial wheel includes a center hub, said hub being secured to one of said front wall or said baffled, said dial wheel being rotatable about said hub.

8. The paperboard container of claim 5 wherein rotation of said dial wheel allows dispensing from any one of said cells or any combination of said cells.

9. A paperboard dispensing container for the storage and dispensing of small objects comprising:

a front wall, said front wall having a plurality of openings formed therein;

a first side wall foldably connected to said front wall;

a second side wall foldably connected to said front wall;

a back wall foldably connected to said first side wall;

a top wall foldably connected to said back wall, said top wall having a slot formed therein;

a baffle foldably connected to said second side wall, said baffled having at least one opening formed therein;

a bottom wall foldably connected to said back wall;

said aforestated walls defining a storage chamber with said baffle defining a plurality of cells within said storage chamber;

a rotatable dial wheel having a plurality of openings formed therein rotatably positioned between said baffle and said front wall and extending at least partially out of said slot in said top wall;

said openings in said dial wheel and said openings in said front wall being positioned so that said respective openings can be placed in alignment by rotation of said dial wheel, said dial wheel being rotatable to allow alignment of one or more of said openings in said dial wheel with said openings in said front wall, said openings, in alignment, forming a continuous opening from at least one of said cells through said front wall for the dispensing of an object from said at least one cell.

10. The paperboard container of claim 9 wherein said rotatable dial wheel includes a center hub, said hub being secured to one of said front wall or said baffle, said dial wheel being rotatable about said hub.

11. The paperboard container of claim 9 wherein rotation of said dial wheel allows dispensing from any one of said cells or any combination of said cells.

* * * * *